United States Patent [19]

Amato et al.

[11] Patent Number: 5,074,907

[45] Date of Patent: Dec. 24, 1991

[54] METHOD FOR DEVELOPING ENHANCED TEXTURE IN TITANIUM ALLOYS, AND ARTICLES MADE THEREBY

[75] Inventors: Richard A. Amato, Cincinnati; Andrew P. Woodfield, Fairfield, both of Ohio; Michael F. X. Gigliotti, Jr.; John R. Hughes, both of Scotia; Lee C. Perocchi, Schenectady, all of N.Y.

[73] Assignee: General Electric Company, Cincinnati, Ohio

[21] Appl. No.: 394,927

[22] Filed: Aug. 16, 1989

[51] Int. Cl.[5] ..... C22C 29/12

[52] U.S. Cl. ..... 75/235; 75/235; 148/11.5 R; 148/11.5 F; 148/11.5 P; 148/11.5 Q; 148/126.1; 148/127; 148/421; 419/19; 419/20; 419/28; 419/29; 419/38; 419/49

[58] Field of Search ..... 419/19, 38, 20, 49, 419/28, 29; 75/232, 235; 198/11.5 R, 11.5 F, 11.5 P, 11.5 Q, 126.1, 127, 421

[56] References Cited

U.S. PATENT DOCUMENTS 4,851,053 7/1989 Froes et al. ..... 148/133

FOREIGN PATENT DOCUMENTS 1030387 8/1964 United Kingdom .
1022806 11/1964 United Kingdom .
1522837 8/1978 United Kingdom .

*Primary Examiner*—Stephen J. Lechert, Jr.
*Attorney, Agent, or Firm*—Jerome C. Squillaro; Carmen Santa Maria

[57] ABSTRACT

Enhanced crystallographic texture is developed in an alpha or alpha-beta titanium alloy having a dispersion of particles therein, by heating the alloy to essentially the all beta phase range and mechanically hot working the alloy in this range. The mechanical working is preferably accomplished by extrusion, rolling, or forging. The particles are stable during working, and prevent the formation of random texture in recrystallized beta phase grains at the working temperature. The particles are preferably oxides formed from rare earth elements such as erbium or yttrium, that are introduced into the alloy during manufacture. The alloys processed according to the invention are preferably prepared by powder metallurgy to achieve a uniform microstructure prior to working. A particularly suitable alpha-beta (but near alpha) titanium alloy contains aluminum, zirconium, hafnium, tin, columbium, molybdenum, tungsten, ruthenium, germanium, silicon, and erbium.

32 Claims, No Drawings

METHOD FOR DEVELOPING ENHANCED TEXTURE IN TITANIUM ALLOYS, AND ARTICLES MADE THEREBY

BACKGROUND OF THE INVENTION

This invention relates to the thermomechanical processing of titanium alloys, and, more particularly, to an approach for attaining a highly textured structure after mechanical working.

Pure metals and metallic alloys solidify with their atoms arranged in highly ordered arrays that are regular and repeating. These arrays, known as the crystallographic structure of the metal, are maintained over large, macroscopic dimensions of the metal piece. For example, the atoms of an alloy may be visualized as lying at the corners and the body center of a cube, producing a "body centered cubic" or BCC crystallography. In another example, the atoms may be visualized as lying in a repeating hexagonal array, producing an "hexagonal close packed" or HCP crystallography. (There are a number of other common types of crystallography as well.) The crystallography of a metallic alloy may be characterized in terms of the type of crystallography (e.g., BCC or HCP) and the orientation in space of the crystallographic unit (e.g., a cube with its faces oriented in particular directions).

Some metals may be composed entirely of only one type of crystallographic structure, which is of the same orientation in space throughout, and such metals are termed "single crystals". In most structural applications, it is preferable to have present contiguous small islands or "grains", each of which has its own crystallographic type and crystallographic orientation in space. The individual grains may each be of the same crystallographic type, or several different types may be present in the same material due to the compositional and processing characteristics of the alloy.

The individual grains may have random crystallographic orientations in space, or they may have a tendency to have their crystallographic directions aligned to some degree. The latter situation is termed a "texture". It is known that particular textures can be beneficial in structural alloys, because the textures produce good combinations of strength, ductility, creep, and fatigue properties. For alloys wherein the properties are dependent upon the texture, the control of texture provides an important way of improving the mechanical properties of the metals.

Many of the properties of metallic alloys can be understood in terms of their crystallographic types and orientations, and the interrelationships of the grains within a metallic piece. For example, if a metal of a selected composition is provided in different crystallographic types, grain orientations, and grain sizes, the resulting properties of the metallic pieces are altogether different. The crystallographic theory of metals is used to relate the properties to these structural parameters. Conversely, once the basic understanding of the relationship between the crystallographic parameters and the metallic properties is attained, then various techniques may be used to select the best properties and further engineer the materials to achieve even better properites.

The development of metallic alloys for use in some of the most demanding aerospace and other applications involves these types of investigations. As an example, titanium alloys are used in portions of aircraft engines and structures because titanium has excellent properties at temperatures of up to about 600 C., and can be processed to attain particularly good mechanical and other types of properties. There is a good fundamental understanding of the relationship of crystallographic characteristics of the titanium alloys to their properties.

However, in some cases, the understanding of metallic properties has outpaced the ability to actually manufacture metals having selected types of properties. Combinations of desirable material properties are sometimes difficult to achieve, and therefore approaches to attaining those properties through careful selection of alloying elements and processing are necessary. The present invention deals with the selection of titanium alloys and their processing to achieve a desirable crystallographic texture.

By way of background, titanium alloys can be classified as alpha phase alloys, beta phase alloys, and alpha-beta phase alloys. Alpha phase alloys have the hexagonal phase crystallography at room temperature, and change to the beta phase crystallography only at very high temperature. The beta phase transforms to alpha phase upon cooling, and there is little beta phase left at room temperature. Beta phase alloys have the beta phase crystallography at room temperature, and retain this structure upon heating and cooling. Alpha-beta alloys are similar to the alpha phase alloys, but actually exhibit both alpha and beta phases at room temperature because the beta phase can be stabilized to exist at room temperature along with the alpha phase.

It is desirable in many cases to process alpha or alpha-beta phase titanium alloys by first heating them into the fully beta phase, working the alloy in the beta phase, and thereafter cooling the alloy. The working of large pieces requires less power when they are hot, and the large prior beta grains produced by this approach lead to good properties in the resulting alloy. Unfortunately, it has been observed that the crystallographic texture produced by working the titanium alloy in the beta phase range is close to random. There has been proposed no approach for achieving textured structures of such materials.

There exists a need for a method of controlling the crystallographic texture of titanium alloys worked in the beta phase range. Such an approach should be compatible with existing working processes, and should permit retention of other desirable characteristics of the titanium alloy. The present invention fulfills this need, and further provides related advantages.

SUMMARY OF THE INVENTION

The present invention provides an approach for achieving an enhanced degree of a preferred crystallographic texture in alpha and alpha-beta titanium alloys. The method of the invention produces structural pieces having such a preferred structure, without requiring major changes in processing procedures. The mechanical properties of the pieces are excellent.

In accordance with the invention, a method for producing a titanium alloy that is highly textured along a selected direction comprises the steps of providing a piece of a titanium alloy having a dispersion of at least about 0.5 volume percent stable particles therein, the titanium alloy being selected from the group consisting of an alpha titanium alloy and an alpha-beta titanium alloy, and the particles being stable to dissolution and substantial coarsening during heating and working at temperatures above the beta transus temperature of the titanium alloy; and mechanically working the piece of the titanium alloy in the selected direction at a temperature above the beta transus temperature.

That is, the titanium alloy is manufactured with a dispersion of particles throughout. The particles are present in an amount of at least about 0.5 volume percent. The maximum permitted volume fraction of particles is determined by the onset of brittleness, which would be uniquely associated with each alloy. Manufacturing is preferably by consolidating titanium alloy powders of a particular composition. The alloy composition is selected to produce a particle dispersion sufficient to control the beta phase during working of the titanium alloy. Processing is at a temperature sufficiently high that at least about 90 percent of the microstructure is in the beta phase.

In accordance with this aspect of the invention, a method for producing a titanium alloy that is highly textured along a selected direction, comprises the steps of providing a piece of a titanium alloy having therein a sufficient type and amount of a dispersion of particles to inhibit beta phase recrystallization of grains having a random texture, during working of the piece in the beta range, the titanium alloy being selected from the group consisting of an alpha titanium alloy and an alpha-beta titanium alloy; and mechanically working the piece of titanium alloy in the selected direction at a temperature sufficiently high that the microstructure of the titanium alloy piece is at least 90 percent of the body cubic centered phase.

In a preferred approach, the titanium alloy contains yttrium or one or more rare earth elements (from the lanthanide series) such as erbium that, in combination with other elements in the alloy, form the dispersion. The dispersion is preferably an oxide of yttrium or a rare earth element. In accordance with this aspect of the invention, a method for producing a titanium alloy that is highly textured along a selected direction comprises the steps of providing a piece of an alpha-beta titanium alloy having a composition that contains at least about 0.5 percent by volume of an oxide of an element selected from the group consisting of a rare earth and yttrium; and mechanically working the piece of titanium alloy in the selected direction at a temperature above its beta transformation temperature.

When an alpha or alpha-beta titanium alloy not having the required dispersion is worked at a temperature wherein only the beta phase is present (that is, above the beta transus temperature), a random crystallographic texture results. Upon cooling below the beta transus and into the alpha phase region, the random texture is retained. It is not possible to attain the benefits that can be achieved with a preferred texture in the material, as achieved by the present approach.

The presence of the dispersoid particles has a surprisingly beneficial effect on the development and retention of a strong texture in the final titanium alloy product. It is believed that this texture is achieved through inhibition of beta phase recrystallization, but whatever the mechanism, the desirable texture is produced. Beta phase working of such a dispersoid-containing titanium alloy produces a strong texture in the predominantly alpha phase product present after cooling.

The titanium alloy is preferably prepared by the powder metallurgy technique of consolidating powders having the required composition. These powders may be made highly uniform in structure, composition, and size. The resulting powder compact, produced by compressing a mass of the powder, also has highly uniform characteristics throughout. This uniformity is desirable, as it reduces the likelihood of failure due to microstructural inhomogeneities. Other techniques for preparing the alloy are acceptable.

Mechanical working in the beta phase range is preferably by extrusion, but can be by rolling, forging, or other techniques that produce deformation predominantly along the direction selected to have the preferred texture. The reduction in area should be at least 6 to 1, and preferably is about 9 to 1, although even larger reductions have been found operable. The deformation should be largely or predominantly in the selected direction, but small amounts of deformation in other directions do not invalidate the approach. Nonaxisymmetric deformation is minimal in extrusion. Varying amounts of biaxial and triaxial deformation are present and are acceptable in rolling, forging, and other metal working processes used to practice the present invention.

An alpha-beta titanium alloy that is particularly well suited to processing by the present invention has been discovered. This alloy has a composition of, in atomic percent, from about 10.5 to about 12.5 percent aluminum, from 0 to about 2 percent zirconium, from 0 to about 3 percent hafnium, from 0 to about 2 percent tin, from 0 to about 1 percent columbium, from 0 to about 2 percent tantalum, from 0 to about 1 percent molybdenum plus tungsten, from 0 to about 1 percent ruthenium, from 0 to about 1 percent of an element selected from the group consisting of ruthenium, rhenium, platinum, palladium, osmium, iridium, rhodium, and mixtures thereof, from 0 to about 1 percent silicon, from 0 to about 1 percent germanium, from about 0.1 to about 1 percent of a metal selected from a rare earth, yttrium, and mixtures thereof, balance titanium totalling 100 percent.

The composition of this alloy is a modified form of that disclosed in commonly assigned and allowed U.S. patent application Ser. No. 213,573, filed June 27, 1988, for which the issue fee has been paid. The disclosure of this Application is incorporated by reference. The alloy is modified from that in the incorporated Application by the addition of germanium and 0 to 1 percent of an element selected from the beta phase forming group of elements ruthenium, rhenium, platinum, palladium, osmium, iridium, rhodium, and mixtures thereof. The germanium provides improved strain aging strengthening to the alloy. Amounts of germanium greater than about 1 percent would be expected to lead to brittleness and a reduction in the melting point of the alloy. The beta phase forming elements, preferably ruthenium, aid in forming the beta phase and should not exceed about 1 percent. If larger amounts are used, the alloy would contain excessive amounts of a weak beta phase, or, at higher levels, become a beta phase alloy, which could not benefit from the thermomechanical processing of the invention to form strong textures.

The present invention provides an advance in the art of providing alloys with tailored microstructures to achieve excellent properties. Normal working operations can be used to develop the texture, and maintenance of the texture is achieved through the modification of the microstructure to include stabilizing dispersoids. Other features and advantages of the present invention will be apparent from the following more detailed description of the preferred embodiment, which illustrates, by way of example, the principles of the invention.

DETAILED DESCRIPTION OF THE PREFERRED EMBODIMENTS

An alpha-beta titanium alloy, that retains little beta at low temperature, was prepared from gas atomized powder. This powder is prepared by directing a stream of molten metal into a gas jet, so that the metal is broken up into small droplets that rapidly solidify. This processing occurs rapidly, and there is little opportunity for segregation to occur. The resulting powder is highly uniform in microstructure.

In the preferred approach, the composition of the powder was 10 percent aluminum, 1.6 percent zirconium, 1.4 percent tin, 0.7 percent hafnium, 0.5 percent columbium, 0.1 percent ruthenium, 1.1 percent erbium, 0.25 percent silicon, 0.25 percent germanium, balance titanium, with all compositions herein given in atomic percent unless stated to the contrary. The gas-atomized powder was passed through standard sieves to obtain the −35 mesh fraction. The required weight of this powder was loaded into a titanium alloy can, which was evacuated and sealed. The can was compressed in a closed die at 840° C. to partially compact the powder. The partial compact was worked by extrusion at 1200° C. with a 9:1 reduction ratio. The beta transus temperature for this alloy is known to be about 1080° C. A portion of the extrusion was solution heat treated at a temperature of 1150° C. for 2 hours and helium quenched, and then given a stabilization heat treatment at a temperature of 600° C. for 8 hours.

The structures of the resulting pieces were evaluated by microscopy and X-ray diffraction analysis. An array of small erbium-based dispersoids was dispersed generally evenly and uniformly through the matrix of titanium alloy. These dispersoids were determined to be both $Er_2O_3$ and $Er_5Sn_3$. The total volume fraction of the dispersoids was about 1.3 percent of the volume of the alloy.

The texture of the samples of the as-extruded and heat treated pieces was determined by standard X-ray diffraction techniques. The inverse pole figure showed three components to the texture. These components, along with the maximum times random intensity and relative ratio of grains having those textures, is shown in the following table:

| Diffraction Plane | Times Random | Ratio of Grains |
|---|---|---|
| 0001 | 38 | 1.5 |
| $\{10\bar{1}1\}$ | 4.5 | 3.7 |
| {1010} | 3 | 0.8 |

This table indicates that, for example, those grains having a (0001) texture had an X-ray diffraction return 38 times that expected for a random array of grains. Further, 1.5/(1.5+3.7+0.8), or 25 percent of the grains having one of these textures had the (0001) texture.

With the present approach there is a significant enhancement of the (0001) texture component of the hexagonal alpha phase. It is known that during the cooling transformation from beta to alpha phases, the (0001) plane in the alpha phase forms parallel to the {110} plane of the body centered cubic beta phase. It can be concluded from this information and detailed analysis of the X-ray diffraction data that there is a preferential texturing of the beta phase in the <110> body centered cubic direction, which is perpendicular to the {110} plane, using Miller indices.

While not wishing to be bound by this possible explanation, it is believed that the dispersoids in the alloy inhibit recrystallization of the alloy during the working in the beta phase. Recrystallization would produce a more random crystallographic structure. Thus, there must be a sufficient amount of the dispersoids present to prevent that recrystallization, by whatever mechanism is operable.

Moreover, the dispersoids must be stable at the mechanical working temperature. "Stability" means that the particles must neither dissolve nor substantially coarsen during the thermomechanical processing. The preferred interparticle spacing is from about 2 to about 10 micrometers with an upper limit of from about 50 to about 100 micrometers, and substantial coarsening would lead to an increase in the interparticle spacing beyond this range and possibly to a spacing whereat the particles would be ineffective in promoting formation of the desired texture.

The following examples are presented as illustrative of the features and advantages of the invention, and should not be taken as limiting the invention in any respect.

Three alloy compositions were processed with various combinations of procedures, and the properties of the resulting materials were evaluated. The compositions are presented in the following Table I

TABLE I

| | Composition (atom percent) | | | | | | | | | |
|---|---|---|---|---|---|---|---|---|---|---|
| Alloy | Ti | Al | Zr | Hf | Sn | Cb | Ta | Mo | Si | Rare Earth |
| UW | bal | 11.9 | 1.2 | | 1.1 | 0.5 | | 0.1 | | 0.5 Er |
| AF1 | bal | 13.6 | | 1.4 | 1.3 | | 0.8 | | 0.6 | 0.4 Y |
| AF2 | bal | 12.2 | 1.7 | 0.7 | 1.4 | 0.5 | | 0.14 | 0.5 | 0.8 Er |

In Table I, "bal" means "balance". A blank in the table indicates that none of the indicated element is in the alloy.

Table II lists several processing conditions that were separately utilized for the three alloys. The process identification is used in conjunction with the specific alloy. All alloys were hot isostatically pressed from prealloyed metal powders of the correct compositions. The powder was passed through standard sieves to obtain the −35 mesh fraction. The required weight of this powder was loaded into a steel or titanium alloy can, which was evacuated and sealed. The can was hot isostatically pressed (HIPped) at the HIPping temperature, HIP Temp, of Table II to compact the powder. The compact was placed into a metal jacket and mechanically hot worked at the extrusion temperature, Extrusion Temp, of Table II by extruding with the reduction in area, Extrusion Reduction, of Table II.

TABLE II

| | | HIP | Extrusion | |
|---|---|---|---|---|
| ID | Alloy | Temp (C.) | Temp (C.) | Reduction |
| P-2 | UW | 840 | 840 | 6:1 |
| P-5 | UW | 840 | 1200 | 7:1 |
| J-2 | AF2 | 840 | 840 | 8:1 |
| J-3 | AF2 | 840 | 840 | 18:1 |
| J-13 | AF2 | 840 | 1200 | 8:1 |
| J-14 | AF2 | 840 | 1080 | 18:1 |
| J-15 | AF2 | 840 | 1080 | 8:1 |
| J-16 | AF2 | 1080 | 840 | 8:1 |
| J-17 | AF2 | 1080 | 1080 | 8:1 |
| G-2 | AF1 | 840 | 840 | 8:1 |

TABLE II-continued

| ID | Alloy | HIP Temp (C.) | Extrusion Temp (C.) | Extrusion Reduction |
|---|---|---|---|---|
| G-6 | AF1 | 840 | 1200 | 8:1 |

A number of different heat treatments were used to treat the extrusions. These heat treatments are summarized in the following Table III:

TABLE III

| Code | Description |
|---|---|
| B | Beta solution plus age for Alloy UW. 1200 C for 2 hours, helium quench, 600 C for 48 hours, cc |
| BA | Direct age for Alloy UW. 600 C for 48 hours cc |
| K | Beta solution plus age for Alloy AF1. 1200 C for 2 hours, helium quench. 710 C for 48 hours, cc |
| AJ | Direct Age for Alloy AF1. 710 C for 48 hours, cc |
| AG | Beta solution plus age for Alloy AF2. 1150 C for 2 hours, helium quench. 600 C for 8 hours, cc |
| AH | Direct Age for Alloy AF2. 600 C for 8 hours, cc |

In this Table III, "cc" means "chamber cooled", which provides a cooling rate of about 1.8° C. per second.

In the following Table IV, the tensile behavior of the extruded and heat treated samples is summarized. The tensile specimens were about 1 inch long with a 0.4 inch gage length and a 0.080 inch gage diameter. The specimens had button head grip ends. In Table IV, "Process" summarizes the alloy, mechanical working conditions, and heat treatment for the various specimens. The codes are those defined in Tables I–III. "Temp" is the tensile testing temperature in degrees C., "0.2% YS" is the yield stress at a plastic offset of 0.2 percent, in thousands of pounds per square inch. "UTS" is the ultimate tensile stress of the specimen in thousands of pounds per square inch. "%Elml" is the percent elongation at maximum loading. "%Elf is the percent elongation at failure. "%ROA" is the percentage reduction in area as measured on the failed specimen.

TABLE IV

| Process | Temp | 0.2% YS | UTS | % Elml | % Elf | % ROA |
|---|---|---|---|---|---|---|
| UW/P2/B | RT | 134.0 | 138.7 | 2.3 | 3.5 | 7.4 |
| UW/P2/B | 650 | 70.3 | 82.8 | 4.8 | 12.1 | 12.1 |
| UW/P5/BA | 650 | 100.7 | 100.7 | 0.1 | 0.1 | 5.6 |
| AF1/G2/K | RT | 154.0 | 162.7 | 4.3 | 4.5 | 6.3 |
| AF1/G2/K | 540 | 102.1 | 113.6 | 1.6 | 1.8 | 3.2 |
| AF1/G2/K | 650 | 89.3 | 103.6 | 4.1 | 14.9 | 24.4 |
| AF1/G2/K | 700 | 80.9 | 90.9 | 2.4 | 17.2 | 24.8 |
| AF1/G6/K | RT | 143.9 | 147.6 | 0.8 | 1.1 | 0.7 |
| AF1/G6/K | 540 | 95.5 | 101.5 | 0.5 | 1.0 | 4.9 |
| AF1/G6/K | 650 | 91.8 | 103.1 | 2.4 | 2.7 | 4.9 |
| AF1/G6/K | 700 | 85.3 | 96.8 | 2.3 | 6.7 | 14.0 |
| AF1/G6/AJ | RT | 182.2 | 183.0 | 0.4 | 0.8 | 1.5 |
| AF1/G6/AJ | 540 | 116.7 | 116.7 | 0.2 | 0.2 | 0.5 |
| AF1/G6/AJ | 650 | 127.4 | 127.4 | 0.1 | 0.1 | 1.2 |
| AF1/G6/AJ | 700 | 123.1 | 125.7 | 0.1 | 0.1 | 0.0 |
| AF2/J2/AG | RT | 150.4 | 155.1 | 3.2 | 3.5 | 10.2 |
| AF2/J2/AG | 540 | 91.3 | 113.8 | 9.1 | 14.7 | 24.0 |
| AF2/J2/AG | 650 | 80.2 | 95.9 | 6.5 | 20.8 | 34.0 |
| AF2/J2/AG | 700 | 70.6 | 79.3 | 1.9 | 28.2 | 38.3 |
| AF2/J3/AG | RT | 168.6 | 174.8 | 5.1 | 5.4 | 8.5 |
| AF2/J3/AG | 540 | 106.4 | 138.8 | 9.9 | 11.9 | 17.6 |
| AF2/J3/AG | 650 | 87.2 | 103.8 | 3.2 | 6.4 | 14.9 |
| AF2/J3/AG | 700 | 86.4 | 100.1 | 3.0 | 7.2 | 15.3 |
| AF2/J13/AG | RT | 145.9 | 154.1 | 3.7 | 4.3 | 5.6 |
| AF2/J13/AG | 650 | 93.7 | 106.7 | 3.2 | 6.1 | 11.7 |

TABLE IV-continued

| Process | Temp | 0.2% YS | UTS | % Elml | % Elf | % ROA |
|---|---|---|---|---|---|---|
| AF2/J13/AG | 700 | 81.7 | 95.1 | 1.9 | 10.9 | 12.1 |
| AF2/J13/AH | RT | 172.4 | 182.9 | 4.6 | 4.9 | 9.2 |
| AF2/J13/AH | 540 | 131.2 | 154.8 | 5.0 | 6.4 | 9.8 |
| AF2/J13/AH | 650 | 126.3 | 142.0 | 2.8 | 4.8 | 10.9 |
| AF2/J13/AH | 700 | 107.5 | 116.9 | 1.3 | 9.1 | 13.2 |
| AF2/J14/AG | RT | 145.2 | 147.3 | 0.7 | 0.8 | 0.5 |
| AF2/J14/AG | 540 | 91.3 | 108.4 | 3.9 | 4.6 | 16.5 |
| AF2/J14/AG | 650 | 86.7 | 102.4 | 3.7 | 8.5 | 12.1 |
| AF2/J14/AG | 700 | 77.3 | 85.8 | 1.3 | 13.2 | 15.3 |
| AF2/J14/AH | RT | 185.4 | 186.8 | 1.2 | 1.9 | 3.2 |
| AF2/J14/AH | 540 | 149.7 | 149.7 | 0.2 | 0.6 | 4.7 |
| AF2/J14/AH | 650 | 139.5 | 155.1 | 2.5 | 3.4 | 6.1 |
| AF2/J14/AH | 700 | 125.0 | 135.9 | 1.3 | 4.1 | 10.9 |
| AF2/J15/AG | RT | 149.1 | 161.0 | 8.6 | 10.3 | 14.4 |
| AF2/J15/AG | 650 | 90.1 | 102.6 | 2.8 | 4.8 | 5.4 |
| AF2/J15/AG | 700 | 85.2 | 96.5 | 1.8 | 8.7 | 14.9 |
| AF2/J15/AH | RT | 183.8 | 185.4 | 1.2 | 1.5 | 2.7 |
| AF2/J15/AH | 540 | 133.4 | 160.7 | 4.4 | 4.5 | 7.8 |
| AF2/J15/AH | 650 | 125.3 | 139.9 | 2.3 | 3.5 | 11.7 |
| AF2/J15/AH | 700 | 104.2 | 115.0 | 1.4 | 10.4 | 14.7 |
| AF2/J16/AG | RT | 159.1 | 165.2 | 4.6 | 4.8 | 7.0 |
| AF2/J16/AG | 650 | 86.3 | 102.7 | 4.1 | 10.8 | 20.6 |
| AF2/J16/AG | 700 | 79.6 | 90.5 | 1.9 | 16.0 | 23.6 |
| AF2/J16/AH | RT | 186.3 | 186.7 | 0.1 | 5.5 | 17.1 |
| AF2/J16/AH | 540 | 109.6 | 119.6 | 6.5 | 16.9 | 27.7 |
| AF2/J16/AH | 650 | 71.6 | 86.4 | 6.8 | 35.7 | 54.7 |
| AF2/J16/AH | 700 | 46.7 | 56.1 | 2.5 | 178.3 | 94.9 |
| AF2/J17/AG | RT | 149.9 | 160.8 | 6.7 | 7.4 | 10.3 |
| AF2/J17/AG | 650 | 96.2 | 110.8 | 2.6 | 4.5 | 4.9 |
| AF2/J17/AG | 700 | 89.4 | 101.4 | 1.7 | 5.0 | 8.1 |
| AF2/J17/AH | RT | 182.3 | 184.1 | 1.0 | 1.2 | 7.8 |
| AF2/J17/AH | 650 | 132.4 | 150.1 | 2.8 | 4.6 | 5.6 |
| AF2/J17/AH | 700 | 113.4 | 123.5 | 1.3 | 5.3 | 6.1 |

In this Table IV, "RT" means "room temperature".

Table V summarizes creep tests performed on the specimens. In Table V, "Process" summarizes the alloy, mechanical working conditions, and heat treatment for the various specimens. The codes are those defined in Tables I–III. The "hours to amount creep" is the number of hours required for the specimen to reach the indicated percentage elongation in creep at a temperature of 650 C. and an applied stress of 20,000 pounds per square inch.

TABLE V

| Process | 0.1% | 0.2% | 0.5% | 1.0% | 2.0% |
|---|---|---|---|---|---|
| UW/P2/B | 0.3 | 1.0 | 5.5 | 17.7 | 47.7 |
| UW/P5/BA | 0.9 | 3.19 | 14.49 | 46.43 | 120.03 |
| AF1/G2/K | 2.73 | 13.45 | 82.73 | 259.48 | 736.78 |
| AF1/G6/AJ | 5.87 | 39.05 | 272.02 | 929.56 | |
| AF1/G6/K | 28.62 | 95.82 | 551.69 | | |
| AF2/J2/AG | 0.83 | 3.09 | 18.35 | 64.20 | 181.89 |
| AF2/J3/AG | 1.40 | 5.58 | 27.40 | 79.39 | 202.59 |
| AF2/J13/AG | 5.08 | 23.61 | 197.48 | 853.63 | |
| AF2/J13/AH | 4.56 | 20.08 | 129.21 | 423.05 | |
| AF2/J14/AG | 6.73 | 31.83 | 221.11 | 949.50 | |
| AF2/J14/AH | 3.13 | 14.04 | 108.89 | 380.03 | |
| AF2/J15/AG | 6.00 | 31.81 | 228.83 | 997.7 | |
| AF2/J15/AH | 2.3 | 10.2 | 74.4 | 259.3 | |
| AF2/J16/AG | 0.61 | 5.34 | 24.49 | 78.13 | |
| AF2/J16/AH | 0.067 | 0.14 | 0.51 | 3.18 | |
| AF2/J17/AG | 8.61 | 36.45 | 224.19 | 813.68 | |
| AF2/J17/AH | 3.08 | 12.89 | 98.25 | 351.57 | |

Table VI summarizes the room temperature elastic modulus measured for selected specimens. "Process" summarizes the alloy, mechanical working conditions, and heat treatment for the various specimens. The codes are those defined in Tables I–III. The "Modulus" is the Young's modulus in millions of pounds per square inch.

TABLE VI

| Process | Modulus |
|---|---|
| AF1/G2/K | 18.3 |
| AF1/G6/K | 18.7 |
| AF1/G6/AJ | 21.0 |
| AF2/J3/AG | 17.8 |
| AF2/J14/AG | 17.9 |
| AF2/J14/AH | 18.7 |

The following Example discussions draw on the results reported above and in the tables.

EXAMPLE 1

Alloy UW was processed by hot isostatic pressing at 840 C. and extrusion at 840 C., process P2, and was also processed by hot isostatic pressing at 840 C. and extrusion at 1200 C., process P5. The material with the P2 processing was given a beta solution plus age heat treatment. The material with the P5 processing was given a direct age heat treatment. Process P5, the extrusion above the beta transus, yielded superior tensile and creep strengths, compared with the process P2, extrusion below the beta transus. The material given the processing P5 with beta phase extrusion had a tensile yield strength at 650 C. of 100,000 pounds per square inch (psi), while the material given an alpha plus beta extrusion P2 had a tensile yield strength of 70,000 psi. The time to 0.5 percent plastic creep at 650 C. and 20,000 psi stress was 14.5 hours for the beta extruded material P5, compared to 5.5 hours for the alpha plus beta extrusion P2.

EXAMPLE 2

Alloy AF1 was processed by hot isostatic pressing at 840 C. and extrusion at 840 C., process G2, and was also processed with hot isostatic pressing at 840 C. and extrusion at 1200 C., process G6. The material prepared with process G2 was given a beta solution plus age heat treatment. The material prepared with process G6 was given a beta solution plus age heat treatment, and in a separate evaluation given a direct age heat treatment.

The tensile yield strength of material prepared with process G6 and given a direct age heat treatment, code AJ, is 18 percent higher at room temperature and 52 percent higher at 700 C. than the material given the alpha plus beta extrusion, process G2. The time to 0.5 percent plastic creep at 650 C. and 20,000 psi stress was 272 hours for beta extrusion processed alloy AF1, process G6, given a direct age, but only 82.7 hours for material processed with the alpha plus beta extrusion G2, an improvement in creep life of 230 percent.

The tensile yield strength of material given a beta solution plus age heat treatment (process G6/K) is 7 percent lower at room temperature but 5 percent higher at 700 C. than the alpha plus beta extrusion material, process G2, which was judged to be an insignificant difference. However, the time to reach 0.5 percent plastic creep was 551.7 hours for the beta extrusion processed material, process G6, given a beta solution plus age, but only 82.7 hours for the material given the alpha plus beta extrusion processing G2, an improvement in creep life of 570 percent.

The Young's modulus of the material with the beta extrusion processing G6 and a direct age heat treatment is 21 million psi, and 18.3 million psi for the material processed by the alpha plus beta extrusion G2. The high modulus resulting from the beta extrusion plus a direct age is indicative of the development and retention of a strong crystallographic texture with [0001] oriented along the axis of the extruded rod. After a beta solution plus age heat treatment, the modulus produced by processing G6 is 18.7 million psi, slightly above that of processing G2, indicating that the alpha to beta to alpha transition associated with the beta solution plus age heat treatment has removed much, but not all, of the strong crystallographic texture.

EXAMPLE 3

Alloy AF2 was processed with an extrusion reduction of 8:1 by hot isostatic pressing at 840 C. and extrusion at 840 C., process J2. It was also processed by hot isostatic pressing at 840 C. and extrusion at 1080 C., process J15. Alloy AF2 was also prepared by hot isostatic pressing at 840 C. and extrusion at 1200 C., process J13. The material prepared by process J2 was given a beta solution plus age heat treatment, and the material prepared by processes J15 and J13 was evaluated with both a beta solution plus age heat treatment and also a direct age heat treatment.

The tensile strength of the material prepared with process J15 and a direct age, code AJ, is 21 percent higher at room temperature and 48 percent higher at 700 C. than the material processed by alpha plus beta extrusion, process J2. The tensile yield strength of the material processed with a 1200 C. beta extrusion (J13) and given a direct age (code AJ) is 15 percent higher at room temperature and 52 percent higher at 700 C. than the material processed by alpha plus beta extrusion J2. The time to 0.5 percent plastic creep was 74.4 hours for the J15 material having a 1080 C. beta extrusion plus direct age and 129.2 hours for J13 1200 C. beta extrusion plus direct age, but only 18.4 hours for J2 alpha plus beta extrusion. The highest temperature extrusion followed by direct age provides the best results for such material.

The tensile yield strength of J15 1080 C. beta extrusion processed material given a beta solution plus age (code AG) is essentially the same at room temperature and 20 percent higher at 700 C. than the same material processed by alpha plus beta extrusion J2. The tensile yield strength of J13 1200 C. beta extrusion material given a beta solution plus age heat treatment (code AG) is 3 percent lower at room temperature and 16 percent higher at 700 C. than the J2 alpha plus beta extrusion material. The time to 0.5 percent plastic creep was 228.8 hours for J15 1080 C. beta extrusion processed material given a beta solution plus age heat treatment, 197.5 hours for J13 1200 C. beta extrusion processed material given a beta solution plus age, but only 18.4 hours for J2 alpha plus beta extrusion processed material. The improvement over J2 material is 1143 percent for J15 material and 973 percent for J13 material, indicating that the beta extrusion processing, at either temperature, is far superior to alpha plus beta extrusion processing.

EXAMPLE 4

Alloy AF2 was processed with an extrusion reduction of 18:1 using two different procedures. In process J3, the hot isostatic pressing was at 840 C. and extrusion was at 840 C., in the alpha plus beta range, while in process J14 the hot isostatic pressing was at 840 C. and the extrusion was at 1080 C., in the beta range.

The tensile yield strength of J14 beta extrusion processed material with a direct age (code AJ) is 10 percent higher at room temperature and 45 percent higher at 700 C. than the J3 alpha plus beta extrusion processed material. The time to 0.5 percent plastic creep was 108.9 hours for the J14 beta extruded material but only 27.4 hours for the J3 alpha plus beta extrusion, an improvement in creep life of 297 percent for beta extrusion over alpha plus beta extrusion.

The tensile yield strength resulting from J14 beta extrusion processing plus a beta solution plus age heat treatment (code AG) is 14 percent less at room temperature and 10 percent less at 700 C. than the J3 alpha plus beta extrusion material. The time to 0.5 percent plastic creep was 221.11 hours for the J14 beta extrusion material heat treated with the beta solution plus age treatment, but only 27.4 hours for J3 alpha plus beta extrusion material similarly processed, an improvement of 707 percent for beta extrusion over alpha plus beta extrusion.

The Young's modulus of the J14 beta extrusion with a direct age heat treatment is 18.7 million psi, compared with a modulus of 17.8 million psi for the J3 alpha plus beta extrusion material. As with the alloy AF1 of Example 2, this modulus difference for the beta extruded material is indicative of strong crystallographic texture with [0001] oriented along the axis of the rod. After a beta solution plus age heat treatment, the modulus of the J14 beta extruded material falls to 17.9 million psi, indicating that the alpha to beta to alpha transition associated with the beta solution plus age heat treatment has removed much but not all of the strong crystallographic texture.

EXAMPLE 5

Alloy AF2 was processed by hot isostatic pressing at 1080 C., and then either alpha plus beta extrusion at 840 C., process J16, or beta extrusion at 1080 C., process J17. Extrusions produced by these two different paths were evaluated with both a beta solution plus age heat treatment (code AG) and also a direct age heat treatment (code AH).

The tensile yield strength of beta extruded plus direct aged (J17/AH) material is essentially the same at room temperature and 142 percent higher at 700 C. than the material extruded in the alpha plus beta range and direct aged (J16/AH). The time to 0.5 percent plastic creep was 98.3 hours for beta extruded and direct aged material, but only 0.5 hours for the alpha plus beta extruded plus direct aged material.

The tensile yield strength of beta extruded material that has been beta solution plus aged (J17/AG) is 6 percent lower at room temperature and 12 percent higher at 700 C. than the same material processed by alpha plus beta extrusion (J16/AG). The time to 0.5 percent creep is 224.2 hours for the beta extruded material but only 24.5 hours for the alpha plus beta extruded material, an improvement in creep life of 815 percent.

Thus, for the AF2 material, the beta extrusion processing yields superior results to the alpha plus beta range processing.

The results of the testing, as discussed in the Examples, demonstrate that the present approach provides the desired texture in the titanium alloy. The texture is manifested in the increased Young's modulus, and also contributes to improved tensile and creep properties of the textured alloys.

The provision of stable particles within the structure of an alpha or alpha plus beta titanium alloy thus produces surprisingly unexpected benefits on the mechanical properties of the final product. Although the present invention has been described in connection with specific examples and embodiments, it will be understood by those skilled in the arts involved, that the present invention is capable of modification without departing from its spirit and scope as represented by the appended claims.

What is claimed is:

1. A method for producing a titanium alloy piece that is highly textured along a selected direction, comprising the steps of:

providing a piece of a titanium alloy having a dispersion of at least about 0.5 volume percent stable particles therein, the titanium alloy being selected from the group consisting of an alpha titanium alloy and an alpha-beta titanium alloy, and the particles being stable to dissolution and substantial coarsening during heating and working at temperatures above a beta transus temperature of the titanium alloy;

heating the titanium alloy piece to a selected temperature above the beta transus temperature so that at least about 90 percent to of the microstructure is transformed to the body-centered cubic phase; and mechanically working the piece of the titanium alloy sufficiently to achieve a ratio of an initial to final cross sectional area of at least about 6 to 1 in the selected direction at the selected temperature.

2. The method of claim 1, wherein the step of providing includes the step of compacting powders of the titanium alloy.

3. The method of claim 1, wherein the particles constituting the dispersion contain an element selected from the group consisting of a rare earth and yttrium.

4. The method of claim 1, wherein the particles constituting the dispersion are oxides of elements selected from the group consisting of a rare earth and yttrium.

5. The method of claim 1, wherein the step of mechanically working is performed by extruding.

6. The method of claim 1, wherein the step of mechanically working is performed by forging.

7. The method of claim 1, wherein the step of mechanically working is performed by rolling.

8. The method of claim 1, including the additional step, after the step of mechanical working, of heat treating the worked material at a temperature above the beta transus temperature.

9. The method of claim 1, wherein the stable particles have an interparticle spacing of from about 2 to about 10 micrometers.

10. The method of claim 1, wherein the composition of the titanium alloy is, in atomic percent, from about 10.5 to about 12.5 percent aluminum, from 0 to about 2 percent zirconium, from 0 to about 3 percent hafnium, from 0 to about 2 percent tin, from 0 to about 1 percent columbium, from 0 to about 2 percent tantalum, from 0 to about 1 percent molybdenum plus tungsten, from 0 to about 1 percent ruthenium, from 0 to about 1 percent of an element selected from the group consisting of ruthenium, rhenium, platinum, palladium, osmium, iridium, rhodium, and mixtures thereof, from 0 to about 1 percent silicon, from 0 to about 1 percent germanium, from about 0.1 to about 1 percent of a metal selected from the group consisting of a rare earth, yttrium, and mixtures thereof.

11. The method of claim 1, wherein the titanium alloy has a microstructure of at least about 90 percent by volume body centered cubic phase during the step of mechanically working.

12. A textured piece of an alpha-beta titanium alloy prepared by the method of claim 1.

13. A method for producing a titanium alloy piece that is highly textured along a selected direction, comprising the steps of:

providing a piece of a titanium alloy having therein a sufficient type and amount of a dispersion of particles to inhibit beta phase recrystallization of grains having a random texture, during working of the piece at temperatures above a beta transus temperature, the titanium alloy being selected from the group consisting of an alpha titanium alloy and an alpha-beta titanium alloy;

heating the titanium alloy piece to a selected temperature above the beta transus temperature to transform at least 90 percent of the microstructure to the body-centered cubic phase; and mechanically working the piece of titanium alloy sufficiently to achieve a ratio of an initial to final cross sectional area of at least about 6 to 1 in the selected direction at temperatures above the beta transus temperature.

14. The method of claim 13, wherein the particles constituting the dispersion are oxides of elements selected from the group consisting of a rare earth and yttrium.

15. The method of claim 13, wherein the particles are present in an amount of at least about 0.5 volume percent.

16. The method of claim 13, wherein the step of mechanically working is performed by extruding.

17. The method of claim 13, including the additional step, after the step of mechanical working, of heat treating the worked material at a temperature above the beta transus temperature.

18. The method of claim 13, wherein the particles have an interparticle spacing of from about 2 to about 100 micrometers.

19. The method of claim 13, wherein the particles have an interparticle spacing of from about 2 to about 10 micrometers.

20. The method of claim 13, wherein the step of mechanical working is initiated at a temperature above the beta transus temperature and proceeds as the piece of the titanium alloy continuously cools from the temperature.

21. A method for producing a titanium alloy piece that is highly textured along a selected direction, comprising the steps of:

providing a piece of an alpha-beta titanium alloy having a composition that contains at least about 0.5 percent of an oxide of an element selected from the group consisting of a rare earth and yttrium;

heating the titanium alloy piece to a selected temperature above the beta transus temperature to transform at least 90 percent of the microstructure to the body-centered cubic phase; and mechanically working the piece of titanium alloy sufficiently to achieve a ratio of an initial to final cross sectional area of at least about 6 to 1 in the selected direction at temperatures above its beta transus temperature.

22. A titanium alloy piece prepared by the process of claim 21.

23. A method for producing a titanium alloy article having highly textured microstructure along a selected direction, comprising the steps of:

providing a titanium alloy powder which further includes at least one dispersoid-forming element selected form the group consisting of a rare earth and yttrium;

compacting the powder at a selected elevated temperature to form a titanium alloy article having an alpha phase and a dispersoid based on the included dispersoid-forming element;

heating the titanium alloy article to a temperature at which the dispersoid is stable above a beta transus temperature of the alloy so that the alloy microstructure is at least about 90 percent by volume body centered cubic phase; and mechanically working the article sufficiently to achieve a ratio of an initial to final cross sectional area of at least about 6 to 1 in the selected direction.

24. The method of claim 23 further including the following steps after the mechanical working step:

solution treating of the mechanically worked article at a selected temperature and for a selected time;

quenching the article from the solution temperature; and stabilization heat treating the article at a selected temperature below the beta transus temperature.

25. The method of claim 24 wherein the selected temperature for solution treating is about 1150° C. and the selected time for solution treating is about 2 hours.

26. The method of claim 24 wherein quenching the article from the solution treating temperature is helium quenching.

27. The method of claim 24 wherein stabilization heat treating is performed at a temperature of about 600° C. for a time of about 8 hours.

28. The method of claim 23 the step of providing a titanium alloy powder includes providing a powder having the composition consisting essentially of, in atomic percent, about 10.5 to about 12.5 percent aluminum, from 0 to about 2 percent zirconium, from 0 to about 3 percent hafnium, from 0 to about 2% tin, from 0 to about 1 percent columbium, from 0 to about 2 percent tantalum, from 0 to about 1 percent molybdenum, from 0 to about 1 percent of an element selected from the group consisting of ruthenium, rhenium, platinum, palladium, osmium, iridium, rhodium, and mixtures thereof, from 0 to about 1 percent germanium, from about 0.1 percent to about 1 percent of a metal selected from the group consisting of rare earth metals, yttrium and mixtures thereof, and the balance titanium and incidental impurities.

29. The method of claim 23 wherein the compacting step further includes selecting a temperature of about 840° C.

30. The method of claim 23 wherein the heating step further includes heating to a temperature of about 1200° C.

31. The method of claim 23 wherein the step of mechanically working is selected from the group consisting of extruding, rolling and forging.

32. The method of claim 23 wherein the step of mechanical working achieves a ratio of an initial to final cross sectional area of about 9 to 1 in the selected direction.

* * * * *